US006520801B2

(12) United States Patent
Tabata et al.

(10) Patent No.: US 6,520,801 B2
(45) Date of Patent: Feb. 18, 2003

(54) CONNECTOR

(75) Inventors: Masaaki Tabata, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/026,149

(22) Filed: Dec. 19, 2001

(65) Prior Publication Data

US 2002/0081913 A1 Jun. 27, 2002

(30) Foreign Application Priority Data

Dec. 21, 2000 (JP) ..... 2000-389133

(51) Int. Cl.[7] ..... H01R 13/40
(52) U.S. Cl. ..... 439/595; 439/752; 439/744
(58) Field of Search ..... 439/595, 744, 439/752, 346, 352, 357

(56) References Cited

U.S. PATENT DOCUMENTS 3,781,760 A 12/1973 Mancini et al. ..... 339/59 M
5,108,318 A * 4/1992 Sakurai et al. ..... 439/744
5,628,652 A 5/1997 Ohsumi
5,672,075 A 9/1997 Maejima
6,280,234 B1 8/2001 Yamamoto et al.

FOREIGN PATENT DOCUMENTS

JP 2000-294334 10/2000

* cited by examiner

*Primary Examiner*—P. Austin Bradley
*Assistant Examiner*—Alexander Gilman
(74) *Attorney, Agent, or Firm*—Anthony J. Casella; Gerald E. Hespos

(57) ABSTRACT

A connector has a housing (10) with a cavity (11) for receiving a terminal fitting (20). A resin lock (13) is cantilevered into the cavity (11) and has a wedge-shaped biting portion (13B) at its leading end. The wedge-shaped biting portion (13B) contacts and bites into a recess-shaped corner (35) formed by an outer surface (27) of the terminal fitting (20) and a locking surface (32). The leading end of the resin lock (13) is pushed toward the outer surface of the terminal fitting (20) if a force acts on the terminal fitting (20) in a withdrawing direction. Thus, even if the resin lock (13) is thinned to reduce its resilient rigidity, there is no possibility of the resin lock (13) being disengaged from the locking surface (32).

6 Claims, 6 Drawing Sheets

CONNECTOR

BACKGROUND OF THE INVENTION

1. Field of the Invention

The present invention relates to a connector in which a terminal fitting is locked by a locking portion.

2. Description of the Related Art

A known connector has a resin housing formed with a cavity and with a resin lock that cantilevers into the cavity. The connector further includes a terminal fitting with a rectangular tubular portion configured for insertion into the cavity. A wall of the tubular portion is embossed to define a locking projection that is engaged from behind by a leading end of the resin lock when the terminal fitting is inserted into the cavity. The resin lock exhibits a resilient rigidity and, therefore, keeps the terminal fitting locked. A connector of this construction is disclosed, for example, in Japanese Unexamined Patent Publication No. 2000-294334.

A demand exists for making connectors smaller. A size reduction can be achieved by reducing the thickness of the resin lock in the projecting direction of the locking projection. However, the resilient rigidity and reliability of the resin lock is reduced if the resin lock is thinned. Thus, the leading end of the thinned resin lock may be deformed away from the locking projection of the terminal fitting if an excessive withdrawing force acts on the terminal fitting.

In view of the above situation, an object of the present invention is to ensure reliability of a locking function by a locking portion even if the locking portion is thinned.

SUMMARY OF THE INVENTION

The invention is directed to a connector with a housing that preferably is formed from a synthetic resin. The housing has at least one cavity formed with a resiliently deformable lock that cantilevers along an inner wall of the cavity. At least one terminal fitting can be inserted into the cavity. The terminal fitting has a locking surface that projects from an outer surface of the terminal fitting at an angle, and preferably substantially at a right angle. The leading end of the lock engages the locking surface to lock the terminal fitting in the cavity. The leading end of the lock is formed with a wedge-shaped biting portion that contacts and/or bites into a recess-shaped corner formed by an outer surface of the terminal fitting and the locking surface when the terminal fitting is moved in a withdrawing direction.

The leading end of the lock is pushed from the projecting or outer end toward the base or inner end (toward the outer surface of the terminal fitting) if a force acts on the terminal fitting in a withdrawing direction. Thus, there is no possibility of the lock being disengaged from the locking surface, even if the lock is thinned to reduce its resilient rigidity, and a highly reliable locking is provided.

A surface of the biting portion opposed to the locking surface preferably is slanted to approach the locking surface as it extends from its projecting or outer end toward its base or inner end. Thus, the resin lock is pushed toward the outer surface of the terminal fitting by the inclination of this slanted surface when a force acts on the terminal fitting in the withdrawing direction.

The base end of the locking surface preferably is cut obliquely to form a wedge-shaped recess that corresponds to the biting portion between the obliquely cut surface and the outer surface of the terminal fitting. As a result, the biting portion fits into the recess and a displacement of the biting portion with respect to the locking surface is restricted more securely. The wedge-shaped recess preferably is inclined such that a displacement of the locking portion is prevented.

The terminal fitting preferably comprises a locking surface wall on which the locking surface is provided and a reinforcing wall on an inner part of the terminal fitting is substantially in contact with the locking surface wall.

The locking surface wall comprises a notch that preferably extends over substantially the entire width of the locking surface wall to at least partly expose the reinforcing wall.

A length of an engaging surface preferably is the sum of a projecting distance of the locking surface and a thickness of the locking surface wall.

According to a further embodiment, the terminal fitting is formed with a beveled portion that has a slanted surface extending in a direction oblique to a terminal insertion direction.

Preferably, an angle of inclination of the slanted surface to the terminal inserting direction is smaller than an angle of inclination between the terminal insertion direction and a trace of displacement of an extending end of the lock during its resilient restoration.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
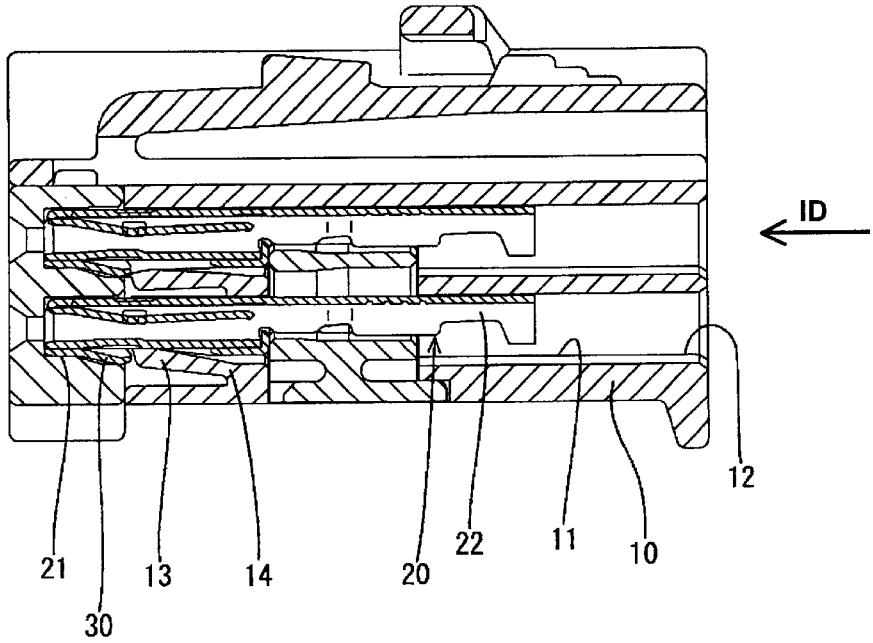
FIG. 1 is a section of one embodiment of the invention.
Figure 2:
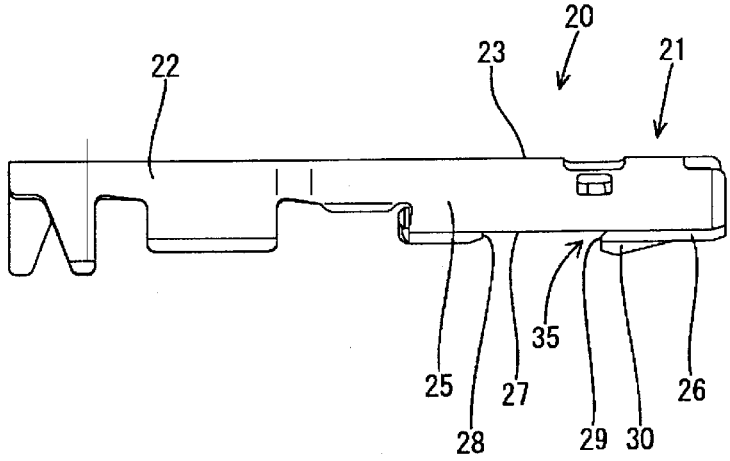
FIG. 2 is a side view of a terminal fitting.
Figure 3:
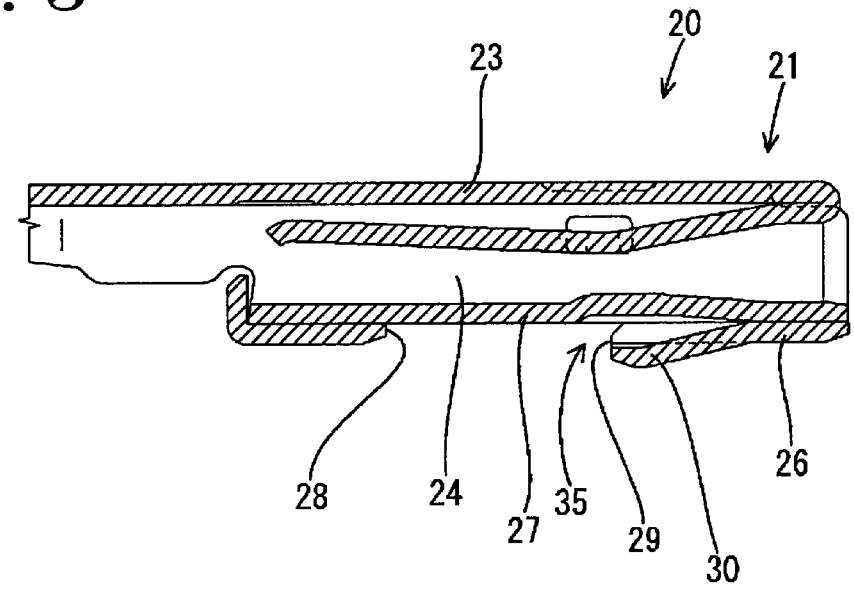
FIG. 3 is a partial longitudinal section of the terminal fitting.

A connector in accordance with the invention is comprised of a housing 10, as shown in FIGS. 1 and 6–9, and terminal fittings 20, as shown in FIGS. 1–9. In the following description, the left side in FIG. 1 is referred to as the front and vertical direction is based on the orientation of FIG. 1. The connector is preferably of the micro-connector type in which the terminal fittings 20 have a width of no more than about 0.64 mm.

Figure 8:
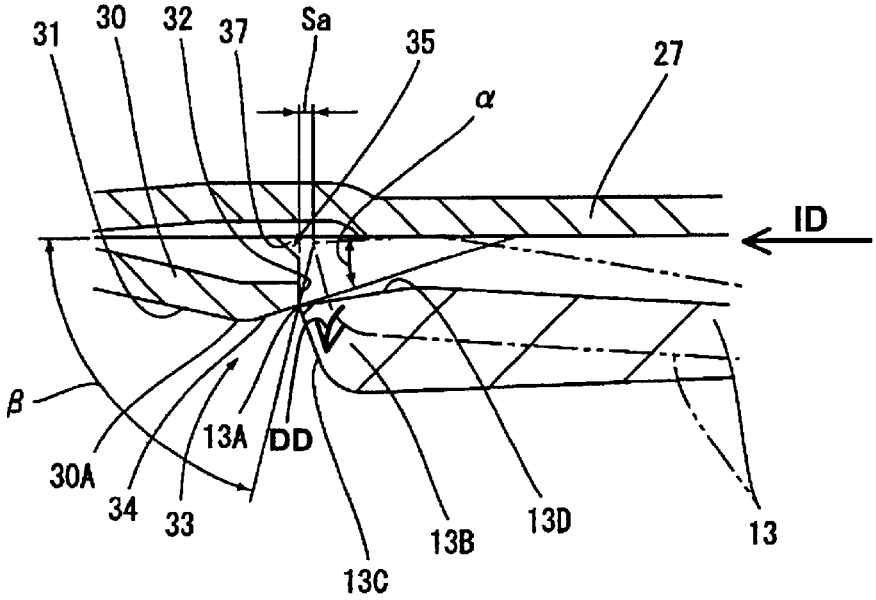
FIG. 8 is a partial enlarged longitudinal section showing a state where the resin locking portion is disengaged from the locking projection to resiliently restore.
Figure 9:
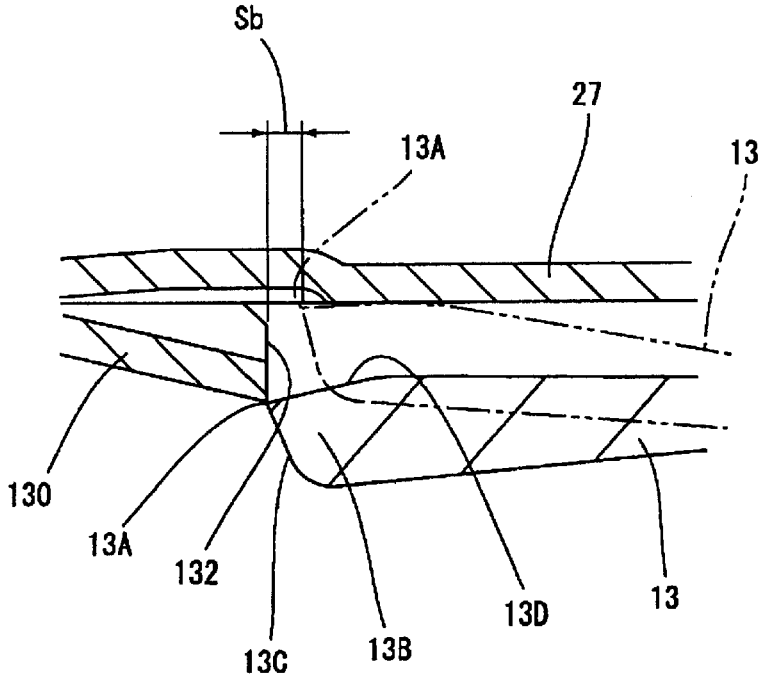
FIG. 9 is a partial enlarged longitudinal section showing a resiliently restoring state of the resin locking portion when the locking projection is formed with no beveled portion.

The housing 10 is formed of a synthetic resin and cavities 11 extend through the housing 10 in forward and backward directions. A terminal insertion opening 12 is defined at the rear end of each cavity 11 and the terminal fittings 20 can be inserted in a forward inserting direction ID through the terminal insertion openings 12 and into the respective cavities 11. A resin lock 13 is cantilevered from a bottom wall 26 of each cavity 11. Each resin lock 13 projects obliquely up and forward from a supporting point 14 at its rear end and is resiliently or elastically deformable downward about the supporting point 14 in a direction away from the cavity 11. An extending end of the resin lock 13 traces a path in a direction DD that is oblique (i.e. at an angle different from 0°, 90° or 180°) to the terminal inserting direction ID when the resin lock 13 is restored resiliently up toward the cavity 11, as shown in FIG. 8.

The front extending end of the resin lock 13 defines a biting portion 13B. A front end surface 13C (surface opposed to a locking surface 32 of the terminal fitting 20 to be described later in forward and backward or longitudinal directions) of the biting portion 13B is slanted toward the front of the housing 10 as it extends from its bottom end to its upper end. An upper surface 13D on the biting portion 13B of the resin lock 13 is substantially parallel with the terminal inserting direction ID. Accordingly, the front end surface 13C and the upper surface 13D of the resin locking portion 13 form an acute angle when viewed sideways, and the biting portion 13B is substantially wedge-shaped.

The terminal fitting 20 has opposite front and rear ends. A substantially rectangular tubular box portion 21 is formed substantially adjacent the front end and a wire crimping portion 22 is formed substantially adjacent the rear end. The box portion 21 has an upper wall 23 and first and second side walls 24, 25 that extend down from lateral side edges of the upper wall 23. An outer bottom wall 26 extends substantially horizontally from the bottom edge of the first side wall 24, and a reinforcing wall 27 extends substantially horizontally from the bottom edge of the second side wall 25. The reinforcing wall 27 is placed on the upper inner surface of the outer bottom wall 26.

Figure 5:
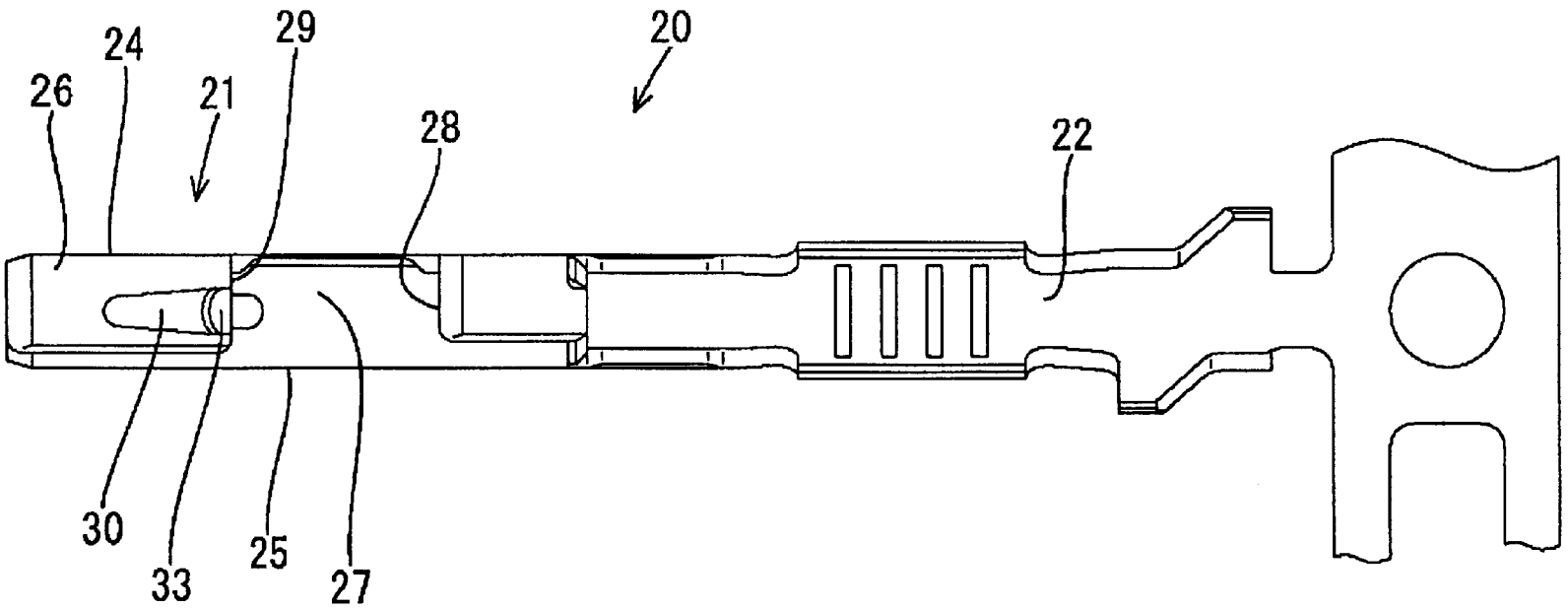
FIG. 5 is a bottom view of the terminal fitting.
Figure 6:
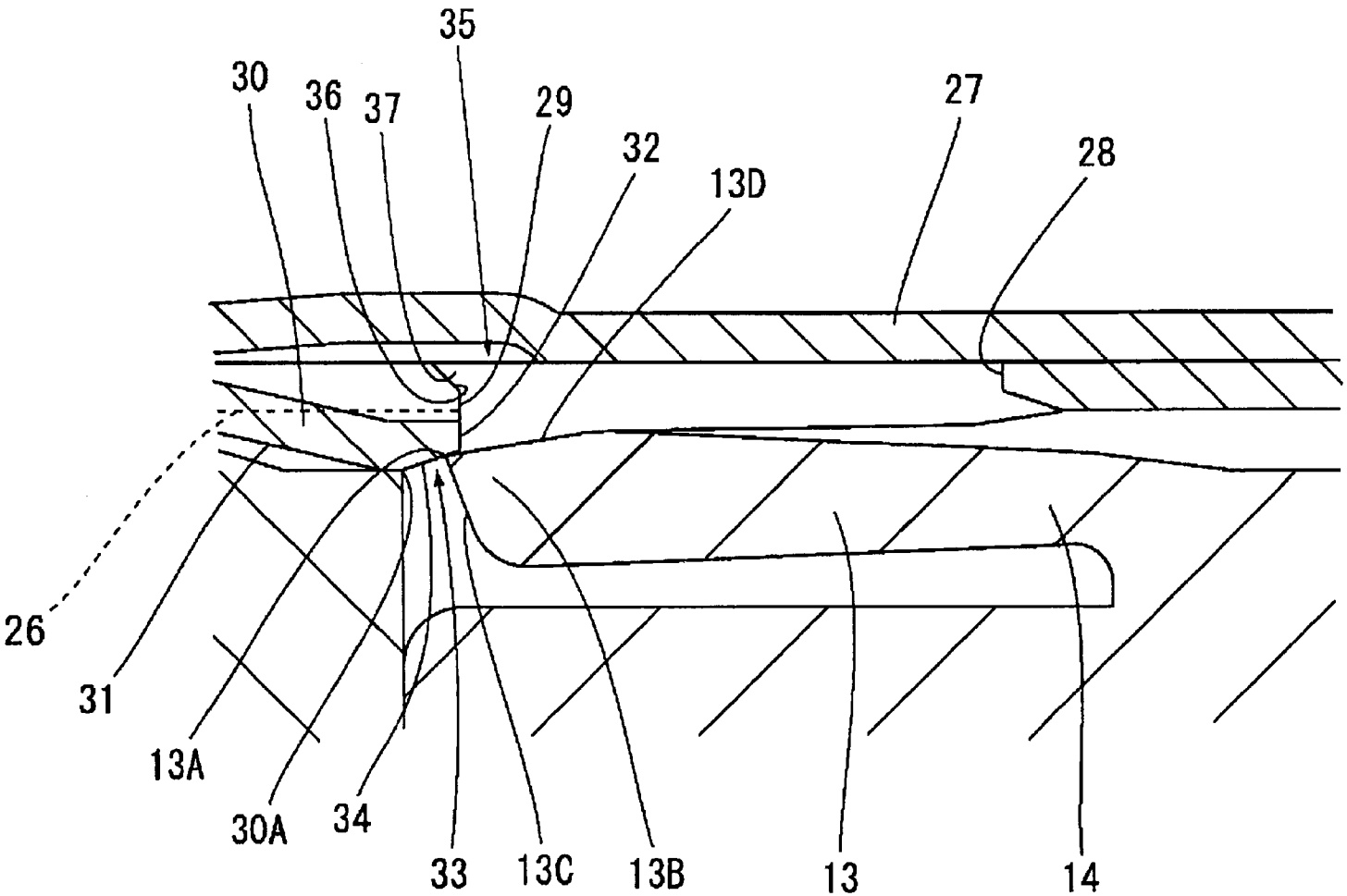
FIG. 6 is a partial enlarged longitudinal section showing a state where a resin locking portion is in contact with a slanted surface of a locking projection.

A substantially middle portion of the bottom wall 26 with respect to the forward and backward directions is cut away to forming a notch 28 that extends over the substantially entire width of the bottom wall 26, as shown in FIG. 5. Accordingly, the reinforcing wall 27 is exposed at the notch 28. A cut surface 29 at the front side of the notch 28 extends straight in a transverse direction substantially normal to the terminal inserting direction ID.

A front part of the bottom wall 26 is embossed at a widthwise center substantially over its rear half to form a locking projection 30 that protrudes down and out. The locking projection 30 has a ridge 31 that is substantially continuous with the bottom wall 26 and extends back from the bottom wall 26 with a projecting distance that increases toward the back. Accordingly, the locking projection 30 is inclined with respect to the terminal insertion direction ID to allow easier deflection of the lock 13 when the terminal fitting 20 is inserted into the respective cavity 11. The locking surface 32 at the rear end of the locking projection 30 is substantially flush with and continuous with the cut surface 29 at the front side of the notch 28, and may be substantially normal to the insertion direction ID. Alternatively, the locking surface 32 may be oblique to the insertion direction so that the projecting or bottom edge of the locking surface 32 is more rearward than upper portions of the locking surface 32 closer to the reinforcing wall 27. The angle of inclination preferably is an oblique angle greater than about 60°, more preferably greater than about 70° and most preferably greater than about 80° with respect to the terminal insertion direction ID or the outer surface 27 of the terminal fitting 20.

A beveled portion 33 is formed at a projecting end (bottom end in FIG. 4) of the locking projection 30 and has a slanted surface 34 that extends in a direction oblique to the terminal inserting direction ID. The inclination of the slanted surface 34 is a reverse of the inclination of the ridge 31 with respect to the longitudinal direction. The slanted surface 34 is slanted in a direction to approach the bottom wall 26 toward the rear end. As shown in FIG. 8, an angle of inclination a of the slanted surface 34 to the terminal inserting direction ID is set smaller than an angle of inclination β which is formed between the terminal insertion direction ID and the traced path of displacement of the extending end 13A of the resin lock 13 during its resilient restoration from a position where the resin lock 13 is engaged with the locking projection 30 to a free state where it can lock the terminal fitting 20.

The extending end 13A of the biting portion 13B on the resin lock 13 obliquely contacts a corner 35 from behind, and hence in a direction that corresponds to the terminal insertion direction ID. The corner 35 preferably is a right-angled recess between the reinforcing wall 27 of the box portion 21 and the locking surface 32 of the locking projection 30 when viewed sideways. The biting of the resin lock 13 into the locking projection 30 can lock a terminal fitting 20 that has been inserted properly into the cavity 11. A wedge-shaped recess 37 is formed at the corner 35 between a slanted cut surface 36 and the outer or lower surface of the reinforcing wall 27 by obliquely cutting the upper end of the locking surface 32 and the cut surface 29 continuous with locking surface 32.

The terminal fitting 20 is inserted into the connector housing 10 so that a projecting end 30A at lowest rear end of the ridge 31 of the locking projection 30 of the terminal fitting 20 contacts the upper surface 13D of the undeflected resin lock 13. As a result, the resin lock 13 is deformed resiliently down while the terminal fitting 20 slides in contact with the upper surface 13D. At this stage, the extending end 13A of the resin lock 13 is displaced obliquely forward to the bottom in a direction oblique to the terminal inserting direction ID.

The projecting end 30A at the rear of the ridge 31 of the locking projection 30 passes the extending end 13A of the resin lock 13 immediately before the terminal fitting 20 reaches the proper insertion position. Thus, the extending end 13A starts moving in sliding contact with the slanted surface 34. During this time, the resin lock 13 is restored slightly and displaced up towards the reinforcing wall 27 by its resilient or elastic restoring force.

The extending end 13A of the resin lock 13 reaches the rear end of the slanted surface 34, as indicated by solid lines in FIG. 8, when the terminal fitting 20 reaches its proper insertion position. As a result, the extending end 13A is disengaged from the slanted surface 34 and is displaced up and back in a direction oblique to the terminal inserting direction ID. This displacement is due to the resilient restoring force of the resin lock 13, and returns the resin lock 13 to its free state shown in chained line in FIG. 8. At this time, the extending end 13A is spaced back from the locking projection 30 by a distance Sa.

The front end surface 13C of the resin lock 13 is opposed to and behind both the locking surface 32 and the cut surface 29 of the locking projection 30. Thus, further backward displacement of the terminal fitting 20 is restricted by the engagement of the resin lock 13 with both the locking surface 32 and the cut surface 29. As a result, the terminal fitting 20 is held locked. Furthermore, a backward displacement of the terminal fitting 20 causes the wedge-shaped biting portion 13B of the resin lock 13 to bite into the wedge-shaped recess 37 of the corner 35. Consequently, a downward resilient displacement of the resin lock 13 away from the locking projection 30 also is restricted.

Figure 4:
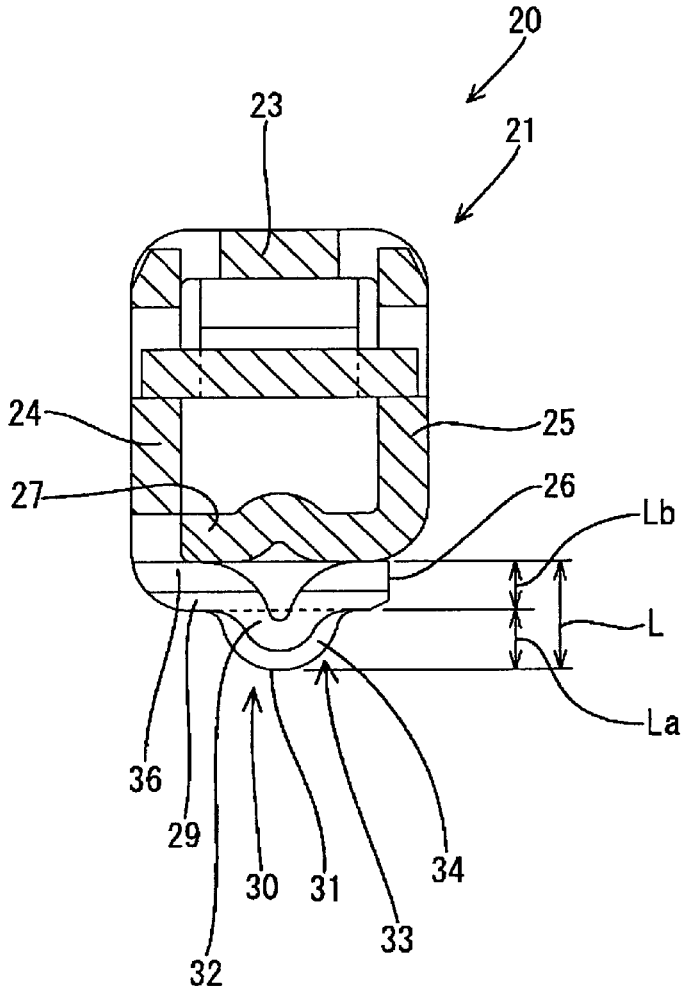
FIG. 4 is a lateral section of the terminal fitting.
Figure 7:
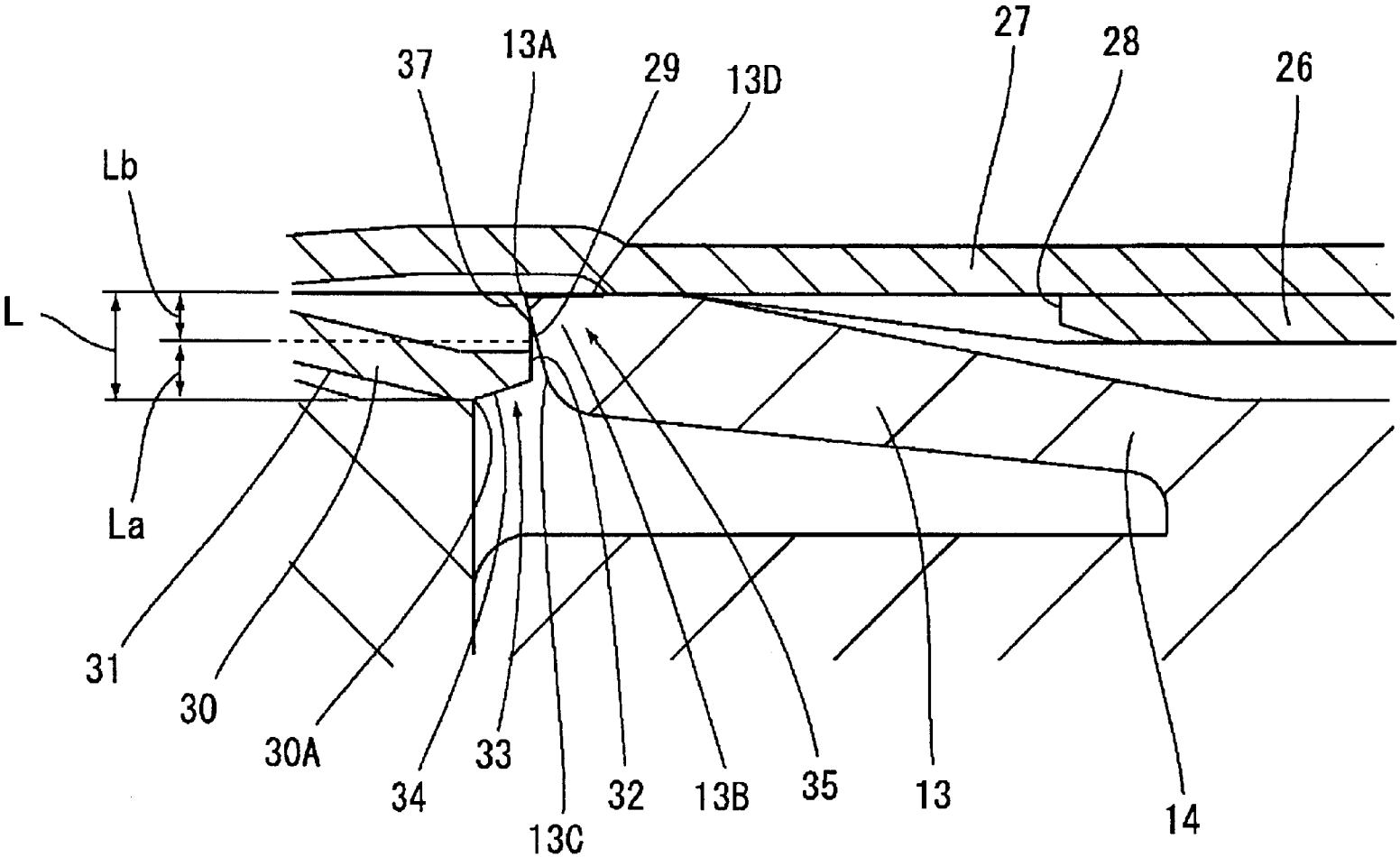
FIG. 7 is a partial enlarged longitudinal section showing a state where the resin locking portion is engaged with the locking projection to lock the terminal fitting.

Part of the cut surface 29 of the notch 28 is substantially flush with and continuous with the locking surface 32 of the locking projection 30. Thus, as shown in FIGS. 4 and 7, an engaging distance L of the terminal fitting 20 and the resin lock 13 can be ensured. The distance L is a sum of a projecting distance La of the locking surface 32 from the bottom wall 26 and a thickness Lb of the bottom wall 26. Therefore, locking reliability is higher than a case where the engaging distance is comprised only of the projecting distance La of the locking projection 30.

The reinforcing wall 27 is on the inner surface of the bottom wall 26 in the box portion 21 of the terminal fitting 20. Accordingly, the bottom wall 26 is strong and the notch 28 can be formed over the entire width of the bottom wall 26. This ensures a wide engaging distance between the terminal fitting 20 and the resin lock 13 to improve reliability of the locking function.

The wedge-shaped biting portion 13B at the leading end of the resin lock 13 contacts and bites into the recess-shaped corner 35 formed by the reinforcing wall 27 of the terminal fitting 20 and the locking surface 32 of the locking projection 30. Thus, a force on the terminal fitting 20 in a withdrawing direction pushes the leading end of the resin lock 13 toward the reinforcing wall 27. Accordingly, there is no possibility that resin lock 13 will disengage from the locking surface 32 even if the resin lock 13 is thinned to reduce its resilient rigidity, and hence a highly reliable locking is provided. Further, the comer 35 has the wedge-shaped recess 37 and the biting portion 13B engages with the recess 37. Thus, a displacement of the biting portion 13B with respect to the locking surface 32 or the cavity 11 is restricted more securely.

The front end surface 13A of the biting portion 13B opposed to the locking surface 32 is slanted. This inclination causes the resin lock 13 to be pushed toward the terminal fitting 20 in response to a force on the terminal fitting 20 in the withdrawing direction, and hence contributes to improved locking reliability.

The slanted beveled portion 33 is formed on the projecting end of the locking projection 30. Thus, a longitudinal clearance Sa necessary for the extending end 13A of the resin locking portion 13 to be disengaged from the locking projection 30 and resiliently restored (see FIG. 8) can be small as compared to a clearance Sb in the case that a locking projection 130 is formed with no beveled portion 33 (see FIG. 9).

The beveled portion 33 is not cut by a surface parallel with the terminal inserting direction ID, but has the slanted surface 34 that extends oblique to the terminal inserting direction ID. Hence, the slanted surface 34 functions similar to the locking surface 32 and the cut surface 29 and performs a locking function with the resin lock 13 if the terminal fitting 20 is pulled in the withdrawing direction with sufficient force to cause the locking projection 30 to bite into the front end surface 13C of the resin lock 13. Accordingly, a large engaging distance of the locking projection 30 and the resin lock 13 can be ensured as compared to a case where the projecting distance of the locking projection is simply made smaller by cutting the beveled portion along a surface parallel with the terminal inserting direction.

The angle of inclination $\alpha$ of the slanted surface 34 to the terminal insertion direction ID is smaller than the angle of inclination $\beta$ between the terminal insertion direction ID and the trace of displacement of the extending end 13A of the resin lock 13 during its resilient restoration. Hence, the extending end 13A of the resin lock 13 moves in sliding contact with the slanted surface 34 during the resilient restoration. Thus, the resilient restoring force of the resin lock 13 and the angle of inclination of the slanted surface 34 cooperate to generate a pushing force on the terminal fitting 20 in the insertion direction ID while the extending end 13A is in sliding contact. This prevents the terminal fitting 20 from being left insufficiently inserted.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

The wedge-shaped recess 37 is formed between the slanted cut surface 36 and the outer surface 27 of the terminal fitting 20 by obliquely cutting the base end of the locking surface 32 in the foregoing embodiment. However, no such recess may be formed according to the present invention.

The locking surface 32 is normal to the terminal inserting direction ID in the foregoing embodiment. However, it may extend oblique to the terminal inserting direction ID according to the present invention.

The wall portion of the rectangular tubular box portion forms the locking projection in the foregoing embodiment. However, the present invention is also applicable to a case where the locking projection is formed on another wall that is not part of the box portion and a case where the terminal fitting is formed with no box portion.

The terminal fitting 20 is described as a female terminal fitting in the foregoing embodiment. However, the present invention is also applicable to a case where the terminal fitting is a male terminal fitting.

What is claimed is:

1. A connector comprising: a housing, at least one cavity being formed in the housing, a resiliently deformable lock being cantilevered along an inner wall of the cavity and having a leading end projecting into the cavity, at least one terminal fitting being at least partly insertable into the cavity, the terminal fitting having a locking surface projecting angularly outwardly, the locking surface being engaged by the leading end of the lock for locking the terminal fitting in the cavity, the leading end of the lock being formed with a wedge-shaped biting portion configured for contacting and biting into a recess-shaped corner formed by an outer surface of the terminal fitting and the locking surface, the biting portion having a surface opposed to the locking surface that is slanted toward the locking surface at locations further in the cavity, the locking surface having base end and a projecting end, the base end of the locking surface being cut obliquely to form a wedge-shape recess opposed to the biting portion of the lock.

2. The connector of claim 1, wherein the wedge-shaped recess is inclined such that a displacement of the lock away from the terminal fitting is prevented.

3. A connector comprising: a housing, at least one cavity being formed in the housing, a resiliently deformable lock being cantilevered along an inner wall of the cavity and having a leading end projecting into the cavity, at least one terminal fitting being at least partly insertable into the cavity, the terminal fitting having a locking surface projecting angularly outwardly, the locking surface being engaged by the leading end of the lock for locking the terminal fitting in the cavity, the leading end of the lock being formed with a wedge-shaped biting portion configured for contacting and biting into a recess-shaped corner formed by an outer surface of the terminal fitting and the locking surface, the terminal fitting comprising an outer wall and a reinforcing wall inwardly of and adjacent to the outer wall, the locking surface being formed in the outer wall, wherein the outer wall comprises a notch to at least partly expose the reinforcing wall.

4. The connector of claim 3, wherein a length of an engaging surface is the sum of a projecting distance of the locking surface and a thickness of the outer wall.

5. A connector comprising; a housing having opposite front end rear ends, at least one cavity being formed in the housing and defining a terminal insertion direction extending from the rear end toward the front end of the housing, a resiliently deformable lock being cantilevered along an inner wall of the cavity and having a leading end projecting into the cavity, at least one terminal fitting having a front end insertable into the cavity the along the terminal inserting direction and having an opposite rear end, the terminal fitting having an outer surface aligned substantially parallel to the terminal insertion direction, a locking surface projecting angularly outwardly from the outer surface of the terminal fitting and facing substantially toward the rear end of the terminal fitting, the locking surface being engaged by the leading end of the lock for locking the terminal fitting in the cavity, a slanted surface extending from the locking surface in a direction oblique to the terminal insertion direction, such that portions of the slanted surface adjacent the locking surface are closer to the outer surface of the terminal fitting than portions of the slanted surface further from the locking surface, and such that the resiliently deformable lock engages the slanted surface during insertion of the terminal fitting into the cavity and urges the terminal fitting toward a full inserted position where the locking surface of the terminal fitting is engage by the leading end of the lock for locking the terminal fitting in the cavity, the leading end of the lock being formed with a wedge-shaped biting portion configured for contacting an biting into a recess-shaped corner formed by the outer surface of the terminal fitting and the locking surface thereof.

6. A connector comprising: a housing, at least one cavity being formed in the housing, a resiliently deformable lock being cantilevered along an inner wall of the cavity and having a leading end projecting into the cavity, at least one terminal fitting being at least partly insertable into the cavity, the terminal fitting having a locking surface projecting angularly outwardly, the locking surface being engaged by the leading end of the lock for locking the terminal fitting in the cavity, the leading end of the lock being formed with a wedge-shaped biting portion configured for contacting and biting into a recess-shaped corner formed by an outer surface of the terminal fitting and the locking surface, the terminal fitting being formed with a beveled portion having a slanted surface extending in a direction oblique to a terminal insertion direction, wherein an angle of inclination of the slanted surface to the terminal inserting direction is smaller than an angle of inclination which between the terminal insertion direction and a trace of displacement of an extending end of the locking portion during its resilient restoration.

* * * * *